US008011053B2

(12) United States Patent
Batzel

(10) Patent No.: US 8,011,053 B2
(45) Date of Patent: Sep. 6, 2011

(54) RESILIENT PIPELINE INSPECTION BRUSH

(76) Inventor: Douglas Batzel, Madison Township, PA (US)

( * ) Notice: Subject to any disclaimer, the term of this patent is extended or adjusted under 35 U.S.C. 154(b) by 970 days.

(21) Appl. No.: 11/660,531

(22) PCT Filed: Sep. 2, 2005

(86) PCT No.: PCT/US2005/031405

§ 371 (c)(1),
(2), (4) Date: Feb. 19, 2007

(87) PCT Pub. No.: WO2006/029008

PCT Pub. Date: Mar. 16, 2006

(65) Prior Publication Data

US 2007/0261186 A1 Nov. 15, 2007

Related U.S. Application Data

(60) Provisional application No. 60/607,387, filed on Sep. 3, 2004.

(51) Int. Cl.
*B08B 9/055* (2006.01)

(52) U.S. Cl. ..... 15/104.061; 15/197; 15/195; 300/21

(58) Field of Classification Search ..... 15/197, 15/104.061; 300/21, 4, 5, 8
See application file for complete search history.

(56) References Cited

U.S. PATENT DOCUMENTS

| | | | | | |
|---|---|---|---|---|---|
| 3,839,763 | A * | 10/1974 | Gould | ..... | 15/181 |
| 4,408,367 | A * | 10/1983 | Pusterhofer | ..... | 15/180 |
| 5,445,438 | A * | 8/1995 | Drumm | ..... | 300/21 |
| 6,726,789 | B1 * | 4/2004 | Weihrauch | ..... | 156/72 |

* cited by examiner

*Primary Examiner* — Shay L Karls
(74) *Attorney, Agent, or Firm* — Riddle Patent Law; Charles L. Riddle

(57) ABSTRACT

A resilient inspection brush used in electrically inspecting pipelines for abnormalities is described which employs highly conductive metals, such as nickel. Since bristles [330] made from these metals cannot be secured firmly by soldering or epoxy, they are folded over a retaining member [350], or wrapped around the retaining member [350]. The retaining member [350] is secured inside of a base housing [320]. The top [321] portion of the base housing [320] may be crimped or swedged to reduce the size of the opening, thereby physically holding the bristles [330]. This also insures that the retaining member [350] does not pass through the opening, securing the retaining member [350] inside of the base housing [320]. In another embodiment, an inner sleeve [810] is used to further secure the bristles [330] and simplify assembly.

20 Claims, 6 Drawing Sheets

RESILIENT PIPELINE INSPECTION BRUSH

RELATED APPLICATIONS

This application claims priority from U.S. Provisional Patent Application 60/607,387 "RESILIENT PIPELINE INSPECTION BRUSH" filed Sep. 3, 2004 in which a portion of the information was originally filed whereas additional information is being filed in this application as a continuation-in-part application.

BACKGROUND OF THE INVENTION

1. Field of the Invention

This present invention relates to the field of pipeline inspection and testing, and more specifically to the field of pipeline inspection using electronic testing apparatus.

2. Discussion of the Prior Art

It is sometimes necessary to periodically inspect gas, oil, water and other metal pipelines for cracks, weakened spots, wall thinning, and other abnormalities caused by wear, trauma and/or corrosion. These typically are inspected using currently known electronic testing techniques, such as a magnetic flux leakage technique. The magnetic flux leakage technique is more fully explained in "Intelligent Pig Inspection of Uncoated Seamless Pipelines" by Terry R. Shamblin, Columbia Gas Transmission, Charleston, W. Va. in the March 200 issue of *Pipeline and Gas Journal*, and in "Research on Intelligent Pipeline Flux Leakage Detector" by Yang-Lijian and Wong-Yumei from the School of Information Science and Engineering, Shenyang Univ. Of Technology, Shenyang, China, hereby incorporated by reference as if set forth in their entirety herein. In this technique, conductive brushes each having a conductive base mounted around the perimeter of a hub, are rotated as they are passed through the inside of a pipeline. A magnetic source passes magnetic flux through the hub, through the base of the brushes and through the bristles. The bristles are brushed against the inner walls of the pipeline, thereby passing magnetic flux into the metal pipeline walls.

A magnetic flux measuring device having a number of magnetic sensors, follows closely behind the inspection brush on or near the pipeline inner surface and reads the remaining magnetic flux. The difference in the magnetic flux induced by the brushes and the readings from the magnetic sensors results in a measure of magnetic flux leakage for each location inside of the pipe. The magnetic flux leakage is related to pipe thinning, pipe weakening, pipe corrosion and other abnormalities. The magnetic flux leakage test therefore is an efficient test for abnormalities of a metal pipeline.

The inspection brush is comprised of a plurality of elongated pencil end brushes, having conductive metal bristles extending from a base cup. These prior art pencil end brushes are typically constructed having metal bristles, usually steel, that are soldered into a base cup. The base cup is connected to a magnetic source and is designed to pass magnetic flux from the magnetic source, to the bristles, then from the bristles to the pipeline walls.

There are known prior art methods of constructing these pencil brushes. These include cutting the bristles to a specified length, inserting them into a cup and attaching to the cup with an attaching medium such as solder or epoxy. The open edge of the cup may or may not be crimped where the bristles enter the cup.

The prior art attachment methods are subject to failure where the bristles are not fully embedded in the attaching medium. Brush integrity requires that every bristle be fully in contact with the attaching medium. Partial contact with the medium results in reduced strength of the brush. It is difficult, if not impossible to assure that each bristle is in full contact and the only method of being certain of that is by a destructive disassembly of the brush.

During use of the inspection brush inside of the pipeline, bristles may be pulled out of or otherwise fall out of the brush or the entire brush may fall apart. The pieces will be dispersed throughout the system. This would cause great damage to the pipeline pumps, valves, seals and related equipment. It would also be a very costly and time consuming process to 'fish' all of the pieces.

Since nickel is a good electrical conductor and conducts magnetic flux very well, nickel plated bristles are preferred. The use of nickel plating would allow the testing process to be performed much more quickly and efficiently indirectly saving large amounts of money in 'down time' since the pipeline may not be used during the testing process. However, the attachment of nickel plated parts is not easily attached using solder or epoxy. This again results in reduced strength of the brush.

Another goal of the brush is to maximize electrical conductivity from the base housing to the bristles to the pipeline wall. Firm contact must be maintained between the base housing and the bristles to maintain high magnetic flux. Bristles that are held partially by solder or epoxy will have reduced contact and therefore reducing conductivity.

An alternate means of securing nickel plated bristles would be to position the bristles inside the base housing, then compress the upper edge of the base housing to crimp the bristles in place. This crimping alone results in a weakened brush with low electrical conductivity.

Therefore, there currently is a need for a high magnetic testing brush which is very resilient and would not release bristles into the pipeline.

SUMMARY OF THE INVENTION

The present invention includes a resilient inspection brush for electronic inspection of pipelines, and method of constructing the same.

The invention employs a plurality of resilient pencil end inspection brushes each having increased magnetic flux capacity. These are constructed of a high flux material, and are constructed without the need for solder or epoxy. They are very resilient and will resist breakage and dismemberment when in use.

The resilient inspection brush includes an electrically conductive base housing having a generally cylindrical shape with a bottom portion and a top portion. A recess passes generally through the base housing lengthwise from top to bottom. The bottom may be enclosed to make a cup shape.

A retaining member is secured in, or near the bottom of the base housing and extends in a direction generally perpendicular to the length of the recess, passing at least partially across the recess.

A number of electrically conductive bristles are tightly packed into the base housing. Each bristle has at least a first end, a second end and a securing portion between the first and second ends. The securing portion of each bristle at least partially encircles the retaining member, with the end portions extending out of the top of the base housing.

The present invention also includes a method for constructing the resilient inspection brush.

First, an electrically conductive base housing is provided having a generally cylindrical shape, a bottom portion, a top portion and a recess passing generally lengthwise from the top to bottom portions.

Next a number of bristles are formed.

The number of bristles are positioning in a generally parallel configuration across the top of the base housing such that they are generally perpendicular to the length of the recess.

The elongated retaining member is positioned across the bristles.

And the retaining member is forced into the recess, thereby folding the bristles into the recess such that they are held in place by the retaining member.

Optionally, the top of the base housing may be swedged to further hold the bristles in place.

The bristles may be made of different materials and tempered or untempered, plated, coated or uncoated of virtually any desired diameter.

DETAILED DESCRIPTION OF THE INVENTION

Figure 2:
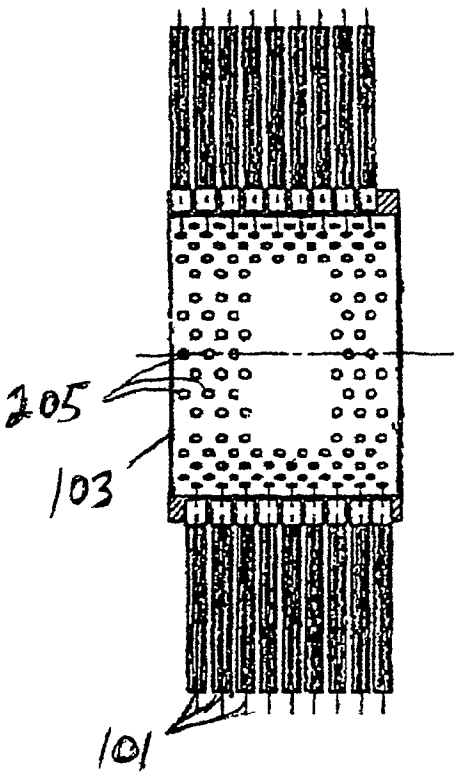
FIG. 2 is a side elevational view of the inspection brush of FIG. 1.
Figure 1:
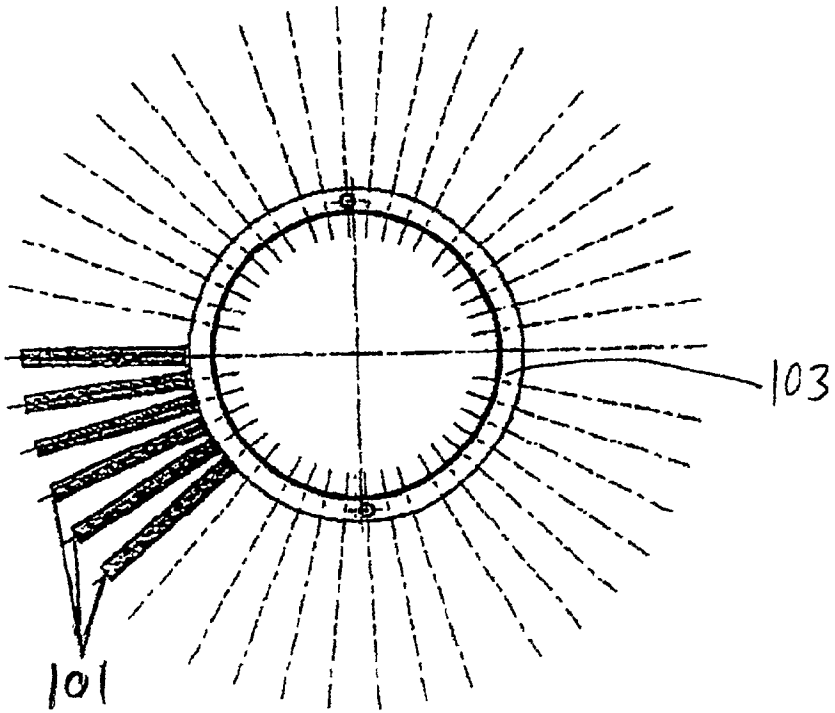
FIG. 1 is a plan view of an inspection brush used for nondestructive testing of metal pipelines having a plurality of pencil end testing brushes mounted on a rotating hub.

FIGS. 1 and 2 show a plan view and a side elevational view, respectively, of an inspection brush assembly having a plurality of conductive brushes 101 each having a conductive base housing mounted in holes 205 around the perimeter of a hub 103. Only a few brushes 101 are shown here for clarity, however they are intended to completely encircle hub 103. The assembly is inserted into a pipeline, preferably as part of a self-contained pipeline inspection device commonly referred to as a "pig". The brushes 101 are rotated as they pass through the inside of a pipeline. A magnetic source located inside of hub 103 causes magnetic flux to pass through hub 103, through the base housing of the brushes 101 and through their bristles. The bristles are brushed against the inner walls of the pipeline, thereby passing magnetic flux into the metal pipeline walls.

Prior art inspection brushes have individual bristles which were soldered, epoxied, or otherwise glued into the base housing. These do not exhibit the electrical conduction properties and strength exhibited by the present invention. These properties are very important since pieces of the inspection brushes which break off can destroy pipeline equipment, make it unusable for a period of time and may be very expensive to repair.

Figure 4:
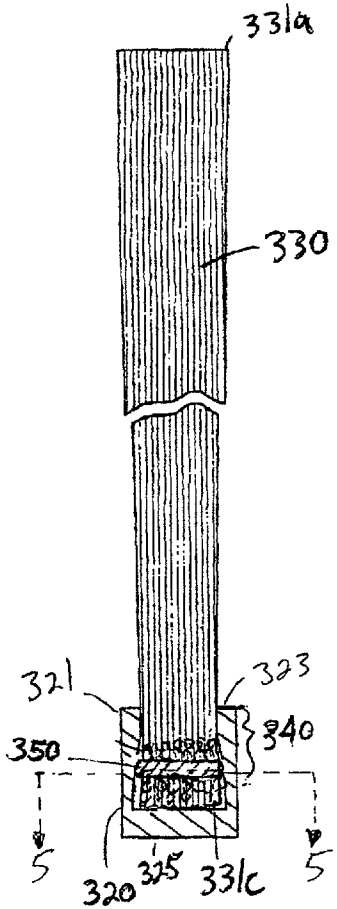
FIG. 4 is a sectional elevational view from the front of the pencil end brush of FIG. 3.
Figure 3:
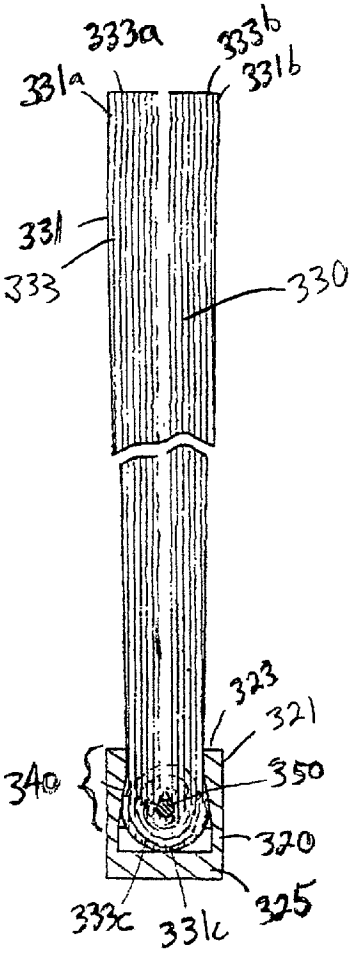
FIG. 3 is a sectional elevational view from the side of a pencil end brush according to one embodiment of the present invention.

FIGS. 3 and 4 show side and front elevational sectional views, respectively, of one embodiment of the present invention having a plurality of bristles 330. The present invention shows a bristle 331 having three parts, a first elongated end 331*a*, a second elongated end 331*b*, and an intermediate securing portion 331*c*. The bristles are made to fold or wrap-around a conductive retaining member 350. Therefore, the intermediate securing portion 331*c* is made to partially encircle retaining member 350, allowing first end 331*a* and second end 331*b* to extend away from the retaining member 350. The ends may be made to extend substantially parallel to each other as shown in FIG. 3, or angle outwardly.

Similarly, other bristles such as bristle 333 also have a first end 333*a*, a second end 333*b*, and a securing portion 333*c*.

The bristles for the brushes may be wire that is tempered or untempered, plated, coated or uncoated in virtually any desired diameter. These wires should be electrically conductive. A number of bristles are packed into base housing 320, thereby causing a tight fit, securing them into the base housing.

The unique configuration of the base housing 320 allows it to retain the substantially straight sides desired by the end users while firmly holding the bristles in the base housing and maintaining tight contact between all of the bristles and the base housing for excellent conductivity.

To further secure retaining member 350 inside base housing 320 and to further secure bristles 331, 333, etc. the top portion 321 of base housing 320 is "swedged" by crimping or compressing top portion 321 into a smaller diameter, physically pressing against the bristles.

Figure 7A:
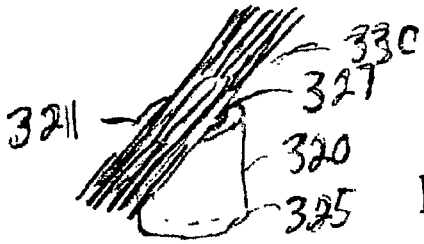
FIGS. 7*a*, 7*b*, 7*c* and 7*d* illustrate a process for making a brush compatible with the present invention.
Figure 7B:
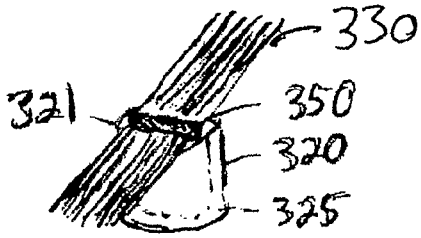
Figure 7C:
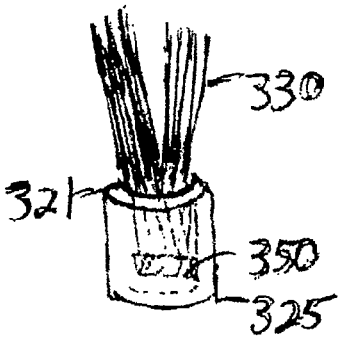
Figure 7D:
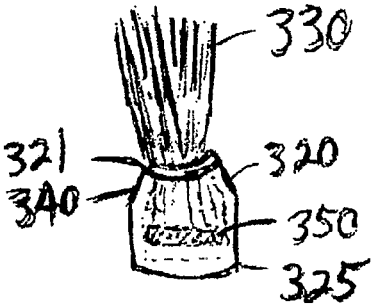

Retaining member 350 may be implemented by using a rod slightly shorter than the internal diameter of base housing 320. If the retaining member 350 is implemented in this manner, swedging base housing 320 after retaining member 350 has been inserted into base housing 320, secures retaining member 350 inside of base housing 320, since it is now too large to pass through the smaller opening in the top portion 321 of base housing 320. (FIG. 7*d* shows a reduce diameter swedged portion 340.)

Retaining member 350 may be secured by other known means as long as the electrical conductivity between base portion 320, retaining member 350 and bristles 331, 333 are maintained.

In an alternative embodiment of the present invention, the securing portion 331*c*, 333*c* of bristles 331, 333 may be wound around securing device 350 several times as shown by the dashed lines shown in FIGS. 3 and 4. Securing portions 331*c* and 333*c* are shown in phantom as concentric circles around retaining member 350 in FIG. 3. These portions are also shown as circles in phantom immediately above and below retaining member 350. Winding these bristles around retaining member 350 would result in improved securing of the bristles, and a more resilient inspection brush.

Figure 5:
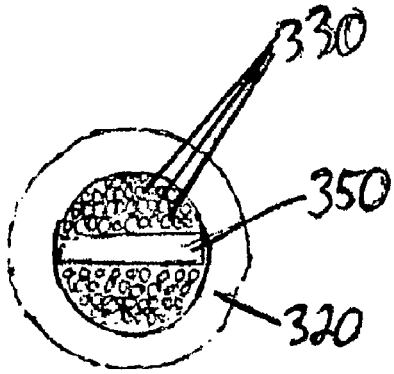
FIG. 5 is a cross-sectional, plan view of the embodiment of FIGS. 3 and 4, as viewed from the line 5-5 of FIG. 4.

FIG. 5 is a cross-sectional, plan view of the embodiment of FIGS. 3 and 4, as viewed from the line 5-5 of FIG. 4. Bristles 330 are shown as circles in phantom emanating from above and below retaining member 350. It can be seen here that retaining member 350 extends from one side of the inner surface of base housing 320 to the other side. Slightly above this level, base housing 320 is the swedging area 340 having a smaller circumference thereby preventing retaining member 350 from being pulled out of base housing 320. (This is shown in FIG. 7*d*.)

Figure 6:
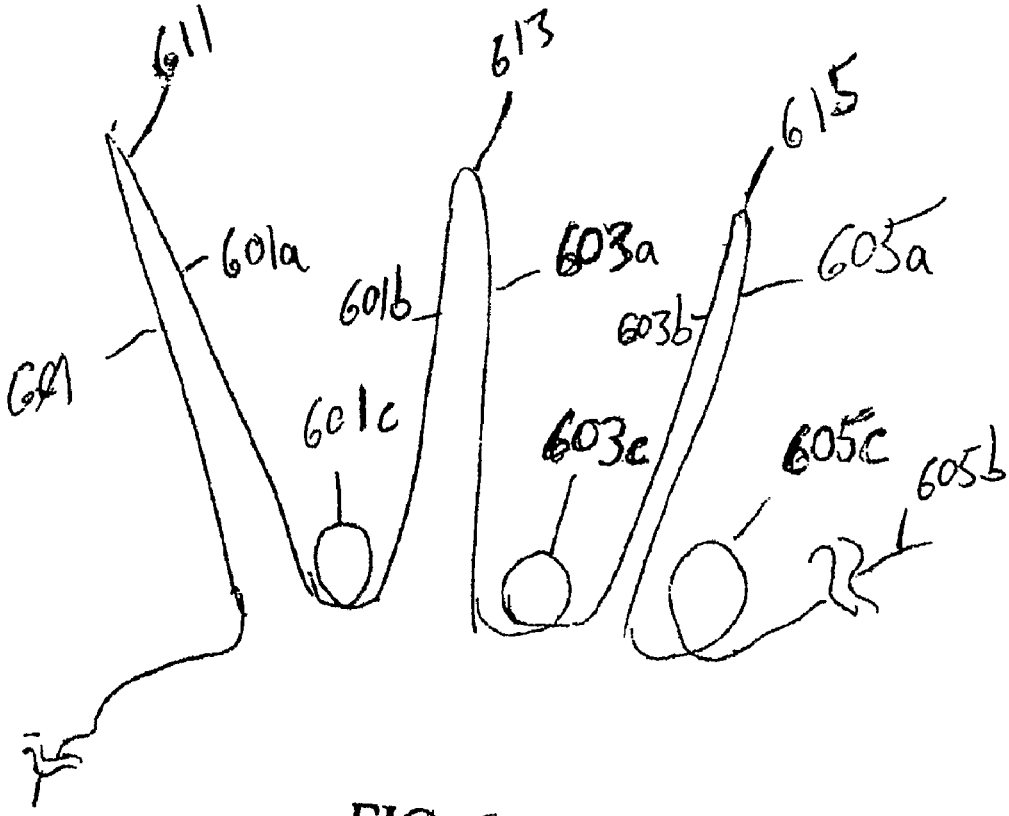
FIG. 6 is an illustration of the bristles of another alternate embodiment of the present invention.

FIG. 6 shows a portion of another alternate embodiment of the present invention. A single wire may be folded back on itself to make a plurality of double stranded bristles 611, 613, 615. A plurality of securing portions 601*c*, 603*c*, and 605*c* are formed between each of the bristles 611, 613, 615. The securing portions 601*c*, 603*c*, 605*c* are intended to be folded back onto each other such that 601*c*, 603*c* and 605*c* are coaxial and fit over retaining member (350 of FIGS. 3 and 4). Since each securing portion would be connected to the retaining member 350, and each bristle would be connected to an adjacent bristle, there is less chance that pieces would break off during use falling into the pipeline and creating damage.

A method of constructing the present invention is described below.

1. An electrically conductive base housing 320 is provided having a generally cylindrical shape, a bottom portion 325 and a top portion 321 with a recess 327 passing generally lengthwise from the top to bottom portions.

2. A number of bristles are formed.

3. The bristles 330 are positioning in a generally parallel configuration across the top of the base housing 320 such that they are generally perpendicular to the length of the recess 327 as shown in FIG. 7*a*.

4. An Elongated Electrically Conductive Retaining member 350 is then positioned across the bristles 330, as shown in FIG. 7*b*.

5. The retaining member 350 is forced into the recess 327, thereby folding the bristles 330 into the recess 327 such that they are held in place by the retaining member 350, as shown in FIG. 7*c*.

Since the bristles are held in place by the retaining pin, brush integrity is maintained.

In another embodiment, each of the bristles 330 are wound at least a full circle around the retaining member 350. The wires are wound before the retaining member 350 is inserted into the base housing 320.

Optionally, the top of the base housing 320 may be compressed in swedged section 340 to further hold the bristles 330 in place as shown in FIG. 7*d*.

Figure 8:
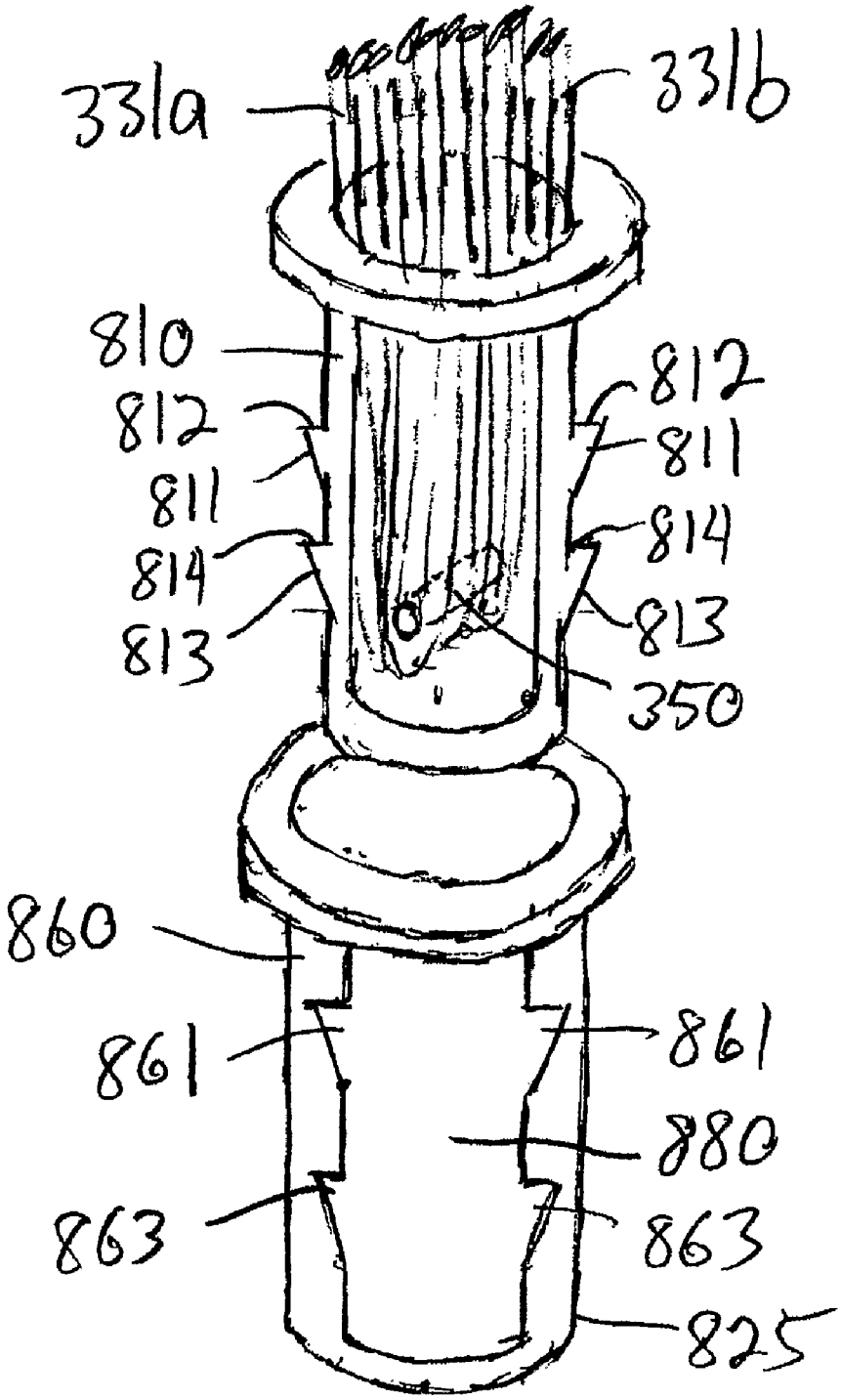
FIG. 8 is a partially cut-away side elevational view of another embodiment of the present invention in a disassembled view.

FIG. 8 is a partially cut-away side elevational view of another embodiment of the present invention in a disassembled view. In this embodiment, there is an inner sleeve 810 which is intended to hold bristles 330 such that the first end 331*a* and the second end 331*b* extend out of inner sleeve 810.

Inner sleeve 810 has at least one catch 811, 813 on its outer surface which are designed to fasten easily to a corresponding groove(s) 861, 863 when inner sleeve 810 is inserted into central recess 880 in base housing 860. It can be seen that the catches are wedge-shaped moving from bottom to top, and have an abrupt shoulder 812, 814 at the uppermost edge thereby resisting release once fastened.

Figure 9:
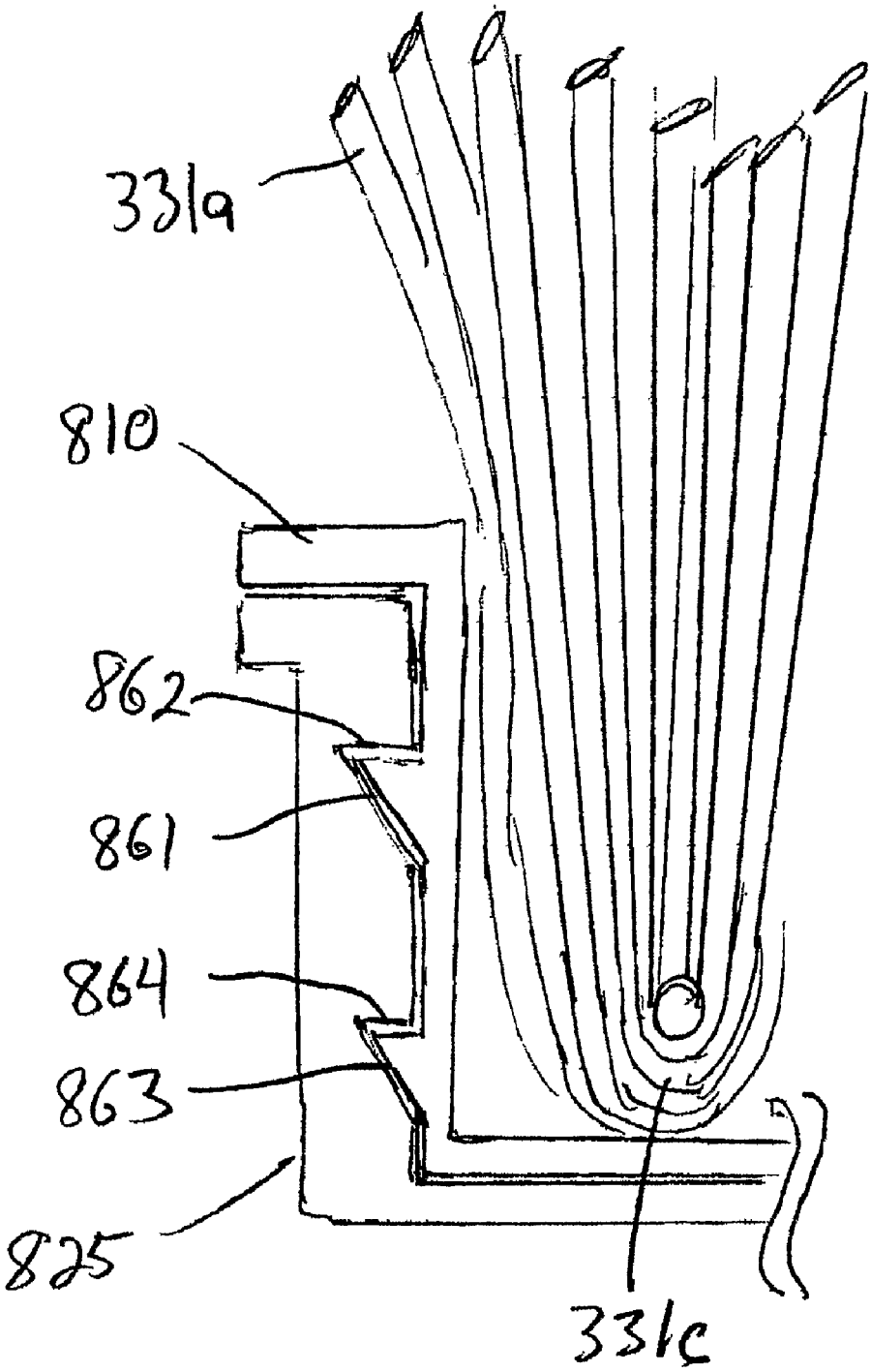
FIG. 9 is a partially cut-away side elevational view of another embodiment of the present invention shown in FIG. 8 in an assembled view.

FIG. 9 is a partially cut-away side elevational view of another embodiment of the present invention shown in FIG. 8 in an assembled view.

In FIG. 9 inner sleeve 810 is shown after it has been pushed into base housing 860. Once catches 811, 813 snap into groove 861, 863 there is a close fit between shoulders 812, 814 and groove upper edges 862, 864 that does not allow release of the parts. This is a one-time fastener and is designed to fasten, but not release.

During assembly of the embodiments above, a solder or thermoplastic may be placed in the bottom (325 of FIG. 3), 825 of base housing (320 of FIG. 3), 860. The base housing (320 of FIG. 3), 860 may then be heated to further hold the bristles 330 in place.

Other epoxies, glues, and adhesives may also be used to further strengthen the assembly.

I claim:

1. A resilient inspection brush device comprising:

a) an electrically conductive base housing [320] constructed from a generally cylindrical wall, having a bottom portion [325] and a top portion [321] with a recess passing generally lengthwise from the top to bottom portions, the top portion being a swedged top portion [340] that more tightly holds the bristles in the base housing [320];

b) electrically conductive retaining member [350] having a first end and a second end positioned near the bottom portion [321] of the base housing [320], with at least one end of the retaining member [350] abutting against the cylindrical wall and extending generally perpendicular to the length of the recess, passing at least partially across the recess, secured in the base housing [320];

c) a plurality of electrically conducting bristles [331] tightly packed in the base housing [320], each bristle [331] having at least a first end [331*a*], a second end [331*b*] and a securing portion [331*c*] between the first end [331*a*] and second end [331*b*], the securing portion [331*c*] of the bristle [331] at least partially encircling the retaining member [350], and the first ends [331*a*] and the second ends [331*b*] extending out of the top portion of the base housing.

2. The resilient inspection brush device of claim 1 wherein the plurality of electrically conductive bristles [331] comprise:

a plurality of nickel plated electrically conductive bristles [331].

3. The resilient inspection brush device of claim 1 wherein the base housing [320] has a closed bottom portion [325].

4. The resilient inspection brush device of claim 1 wherein at least two of the plurality of electrically conducting bristles [331] are constructed from a single wire.

5. The brush of claim 1, the conductive retaining member being a rod.

6. A method for constructing a resilient inspection brush comprising the steps of:

a) providing an electrically conductive base housing [320] constructed from a generally cylindrical wall, having a bottom portion [325] and a top portion [321] with a recess passing generally lengthwise from the top to bottom portions;

b) forming a plurality of bristles [331];

c) positioning the plurality of bristles [331] in a generally parallel configuration across the top portion [321] of the base housing [320] such that they are generally perpendicular to the length of the recess;

d) positioning an elongated retaining member [350] having a first end and a second end, across the bristles [331];

e) forcing the retaining member [350] into the recess such that at least one end of the retaining member [350] abuts against the cylindrical wall, thereby folding the bristles [331] into the recess such that they are held in place by the retaining member [350]; and f) swedging the top portion [321] of the base housing [320] so as to crimp it tightly against the bristles [331] to hold them more securely.

7. The method of claim 6, after the step of forcing the retaining member [350], further comprising the step of:

securing the retaining member [350] in the base housing [320] in an electrically conductive manner.

8. The method of claim 6 wherein the step of providing a base housing, comprises:

providing a base housing [320] having a closed bottom portion [325].

9. The method of claim 6 step further comprising the step of cutting the retaining member [350] to size.

10. The method of claim 6, the elongated retaining member being a rod.

11. A resilient inspection brush constructed by performing the steps comprising:

a) providing an electrically conductive base housing [320] constructed from a generally cylindrical wall, having a bottom portion [325] and a top portion [321] with a recess passing generally lengthwise from the top portion [321] to bottom portion [325];

b) forming a plurality of electrically conductive bristles [331];

c) positioning the plurality of bristles [331] in a generally parallel configuration across the top portion [321] of the base housing [320] such that they are generally perpendicular to the length of the recess;

d) positioning an elongated electrically conductive retaining member [350] across the bristles [331];

e) forcing the retaining member [350] into the recess such that at least one end of the retaining member [350] abuts against the cylinder wall, thereby folding the bristles [331] into the recess such that they are held in place by the retaining member [350]; and f) after forcing the retaining member [350] into the recess, swedging the top portion [321] of the base housing [320] so as to crimp it tightly against the bristles [331] to hold them more securely.

12. The method of claim 11, after the step of forcing the retaining member [350], further comprising the step of:

securing the retaining member in the base housing.

13. The method of claim 11 wherein the step of forming a plurality of electrically conductive bristles [331], comprises the step of:

cutting a plurality of nickel plated electrically conductive bristles [331] to predetermined length.

14. The method of claim 11 further comprising the step of cutting the retaining member [350] to size.

15. The method of claim 11, the elongated electrically conductive member being a rod.

16. A method for constructing a resilient inspection brush comprising the steps of:

a) providing an electrically conductive base housing [320] constructed from a generally cylindrical wall, having a bottom portion [325] and a top portion [321] with a recess passing generally lengthwise from the top portion [321] to the bottom portion [325];

b) forming a plurality of electrically conductive bristles [331, 611, 613, 615];

c) wrapping a central portion [331*c*, 611*c*, 613*c*, 615*c*] of at least one bristle [331, 611, 613, 615] having a first end [331*a*, 601*a*, 603*a*, 605*a* and a second end [331*b*, 601*b*, 603*b*, 605*b*] around a retaining member [350] having at least a first end and a second end allowing the at least one bristle [331, 611, 613, 615] to extend away from the retaining member [350] in generally the same direction of the bristle [331]

d) securing the retaining member [350] and the central portion [331*c*, 607, 609, 611] of each bristle [331, 611, 613, 615] into the recess such that at least one end of the securing member [350] abuts the cylinder wall, thereby holding the bristles in place by the retaining member [350], and allowing conduction between the bristles [331, 611, 613, 615], retaining member [350], and the base housing [320]; and e) swedging the top portion [321] of the base housing [320] so as to crimp it tightly against the bristles [331] to hold said bristles more securely.

17. The method of claim 16 further comprising, repeating the step of wrapping for a plurality of bristles [331, 611, 613, 615].

18. The method of claim 16 wherein the step of forming a plurality of electrically conductive bristles [331, 611, 613, 615] comprises the step of:

cutting a plurality of nickel plated electrically conductive bristles [331, 601, 603, 605] to a predetermined length.

19. The method of claim 16 wherein the step of forming a plurality of conductive bristles [331, 611, 613, 615] comprises the step of:

forming a plurality of conductive bristles [331, 611, 613, 615] from a single wire.

20. A resilient inspection brush device comprising:

a) an electrically conductive inner sleeve [810] having a generally elongated cylindrical wall, with a recess passing generally lengthwise through the inner sleeve [810], b) electrically conductive retaining member [350] having a first end and a second end positioned at least partially across the recess with at least one abutting and secured in the inner sleeve [810];

c) a plurality of electrically conducting bristles [331] tightly packed in the inner sleeve [810], the inner sleeve swedged to hold the plurality of bristles, each bristle [331] having at least a first end [331*a*], a second end [331*b*] and a securing portion [331*c*] between the first end [331*a*] and second end [331*b*], the securing portion [331*c*] of the bristle [331] at least partially encircling the retaining member [350], and the first end [331*a*] and the second end [331*b*] extending out of the top portion of the base housing [860]; and d) a base housing [860] having a central recess [880] for receiving the inner sleeve [810] and for securely retaining the inner sleeve [810].

* * * * *